United States Patent [19]

Dobrzanski

[11] 4,038,649

[45] July 26, 1977

[54] SMOKE DETECTION ALARM DEVICE

[75] Inventor: John Dobrzanski, New Britain, Conn.

[73] Assignee: Emhart Industries, Inc., Farmington, Conn.

[21] Appl. No.: 613,856

[22] Filed: Sept. 16, 1975

[51] Int. Cl.[2] ..... G08B 17/10

[52] U.S. Cl. ..... 340/237 S; 250/381

[58] Field of Search ..... 340/237 S; 250/381, 250/382, 384, 385

[56] References Cited

U.S. PATENT DOCUMENTS

| | | | |
|---|---|---|---|
| 3,521,263 | 7/1970 | Lampart et al. | 340/237 S |
| 3,676,680 | 7/1972 | Scheidweiler et al. | 340/237 S X |
| 3,728,706 | 4/1973 | Tipton et al. | 340/237 S |
| 3,753,258 | 8/1973 | Honda | 340/237 S X |
| 3,922,655 | 11/1975 | Lecuyer | 340/237 S |

*Primary Examiner*—John W. Caldwell
*Assistant Examiner*—Daniel Myer
*Attorney, Agent, or Firm*—McCormick, Paulding & Huber

[57] ABSTRACT

An ac powered smoke detector utilizes an ionization chamber as the sensing element and a threshold circuit including a programmable unijunction transistor for activating an annunciator device such as a horn. An ac-to-dc converter provides regulated dc power to the chamber, the threshold circuitry and the annunciator for operation. When a specified level of smoke exists within the chamber, the programmable unijunction transistor is placed in the conductive state and produces a non-latching activating signal which energizes the horn. To insure that the programmable unijunction transistor makes a positive transition into the conductive state at the threshold level, the anode-cathode circuit of the transistor and the transistor itself are jointly selected to provide an anode current greater than the characteristic valley current of the transistor when the threshold level is reached.

10 Claims, 3 Drawing Figures

SMOKE DETECTION ALARM DEVICE

BACKGROUND OF THE INVENTION

The present invention relates to smoke detection devices and is concerned, more particularly, with a smoke detection device utilizing an electrically operated ionization chamber and the associated circuitry which energizes an alarm signal annunciator.

Ionization smoke detectors are becoming more common devices for monitoring unsafe levels of particulate matter or smoke and detecting fires in commercial, industrial, and residential buildings. Since utility power is generally available in such buildings and such power is generally not interrupted during the incipient stages of a fire or other unsafe smoke condition when alarm signals are needed, it is convenient to energize the smoke detectors with such power.

With ample power available to energize the ionization chamber, the detection circuitry and the annunciator triggered by the detection circuitry, it is possible to design a solid state alarm device which produces a continuous and non-latching alarm signal whenever an unsafe level of smoke exists.

It is, accordingly, a general object of the present invention to provide a smoke detection alarm device which provides a clear and accurate alarm signal whenever an unsafe smoke or other condition exists.

SUMMARY OF THE INVENTION

The present invention resides in a smoke detection alarm device having an ionization chamber as the primary sensing element for detecting unsafe smoke conditions. The chamber is comprised principally of a radiation source and two electrodes separated by an open space through which ambient air and smoke passes from the regional or zone being monitored by the alarm device. Such chamber exhibits an electrical resistance which varies in relation to the obscuration produced by the particulate matter in the smoke.

The ionization chamber is connected in series with a resistive member to form a voltage divider having an output which varies in accordance with the resistance of the chamber. A regulated dc power supply which, for example, may be a converter, is connected across the voltage divider for energization. Annunciating means, such as a horn or other signalling device, is activated by a threshold circuit means which connects the ionization chamber to the annunciating means and produces the activating signal for initiating the alarm signal when the unsafe smoke condition or other unsafe condition exists. Both the threshold circuit means and the annunciating means may be energized from the dc power supply.

The threshold circuit means includes a programmable unijunction transistor connected with the output of the voltage divider including the ionization chamber and with a second voltage divider connected across the dc power supply for establishing a reference voltage. The gate of the programmable unijunction transistor is connected with the output of the first voltage divider including the ionization chamber to respond to variations in the resistance of the chamber while the anode is connected to the output of the second voltage divider establishing the reference voltage level. The transistor switches between the non-conductive and conductive states at a threshold level corresponding to an unsafe smoke condition and provides an activating signal which operates the annunciating means.

To insure that the programmable unijunction transistor makes a positive transistion from the non-conductive to conductive state at the threshold level as the smoke level increases, the anode-cathode circuit and the transistor are jointly selected to provide an anode current greater than the characteristic valley current of the transistor when the smoke level switches the transistor into the conductive state. Thus, a precise and clear activating signal is generated and the alarm is given as the unsafe smoke condition is reached.

To enable the alarm device to be activated by other remote sensors such as heat or flame switches, two terminal posts are electrically connected with the anode and cathode of the programmable unijunction transistor. Other terminal posts are provided in the alarm device to activate other remotely located alarm devices or annunciators.

DESCRIPTION OF THE PREFERRED EMBODIMENTS

Figure 1:
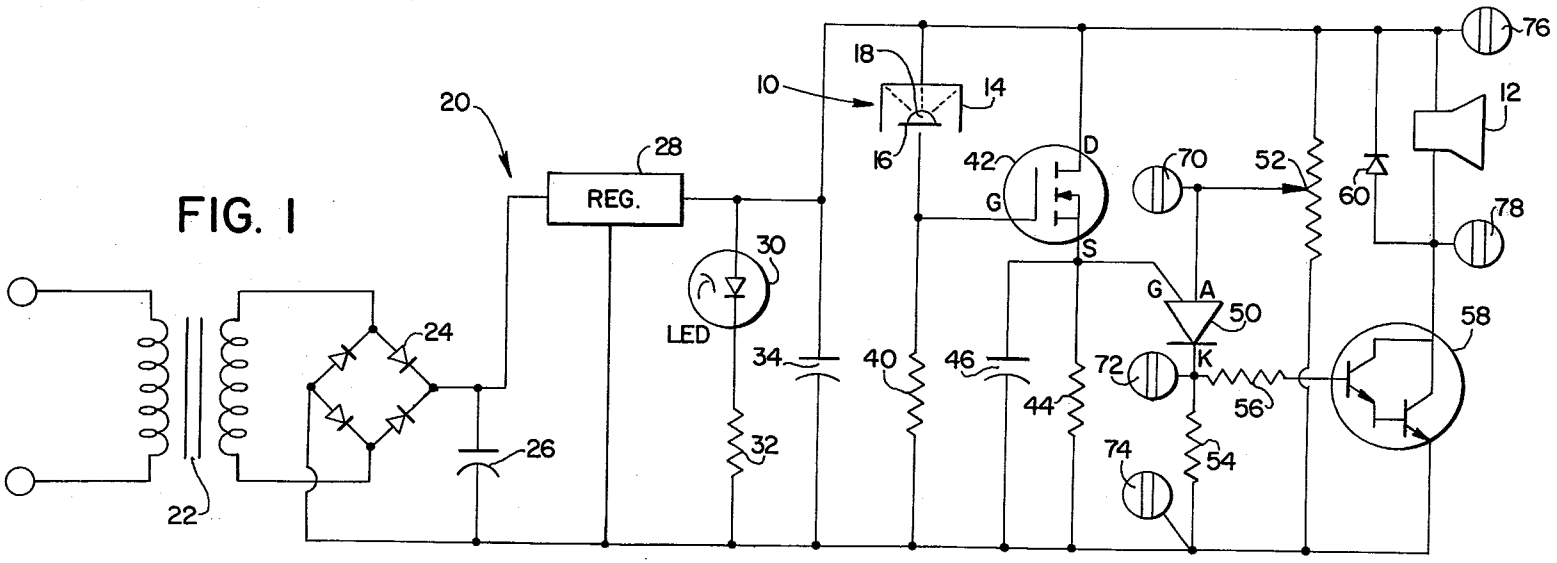
FIG. 1 is an electrical schematic of the smoke detection alarm device of the present invention.

FIG. 1 illustrates a smoke detection alarm device which is operated by standard utility power such as that found in industrial, commercial, and residential buildings and which provides an audible alarm signal in the presence of an unsafe smoke condition. The primary sensing element of the alarm device is an ionization chamber 10 which is placed in a zone to be monitored and which causes an annunciator, such as the horn 12, to produce a warning or alarm signal when the level of smoke in the zone exceeds a predetermined level.

The ionization chamber is comprised of two electrodes 14 and 16 separated by an open space through which ambient air from a zone being monitored passes. Within the open space and adjacent one of the plates is a radiation source 18 which emits alpha particles that cause an ionization current to flow between the electrodes 14 and 16 when a dc voltage is applied to the electrodes. A more complete description of one such chamber can be found in copending application Ser. No. 409,647 entitled Ionization Smoke Detector and Alarm System, filed Oct. 25, 1973 by Dobrzanski et al and having the same assignee as the present invention. The operating characteristics of such an ionization chamber are such that when particulate matter from smoke enters the chamber, the flow of ions through the chamber is impeded and the apparent resistance thusly increases. The greater the concentration of particulate matter, the greater the resistance, and by monitoring the variation in resistance it is possible to detect an unsafe smoke condition and trigger the horn 12 to generate the alarm signal.

An ac-to-dc converter, generally designated 20, is provided as the dc power supply for both the ionization chamber and the associated circuitry which triggers and energizes the horn 12. The converter includes a step-down transformer 22 which is connected to a utility power outlet or other ac source and reduces the utility voltage level to a level of, for example, 18 volts. A standard diode bridge rectifier 24 converts the reduced ac voltage to, for example, approximately 28 volts dc, which is filtered and smoothed by the capacitor 26. The filtered voltage is then applied to a regulator 28 which may be any one of a number of integrated circuit dc regulators requiring no additional external components or power sources. The output of the regulator is a preset voltage such as 12 volts dc and this output voltage is applied to both the ionization chamber and the detection and alarm circuitry for operating the alarm device. A light emitting diode 30 and a current limiting resistor 32 are connected across the output of the converter 20 to provide a visual indication that dc power for the alarm device is on. The capacitor 34 is provided to eliminate transients at the converter output.

The ionization chamber 10 is connected in series with a resistor 40 to form a voltage divider having an output at the junction of the resistor and the electrode 16 of the chamber. The regulated voltage from the converter 20 is applied across the voltage divider so that its output tracks the variation in resistance of the chamber. Generally the resistor 40 has a resistance value comparable to that of the chamber so that the quiescent voltage divider output is approximately half of the regulated voltage from the converter.

Since both the ionization chamber 10 and the resistor 40 have relatively high resistances, very small ionization currents pass through the voltage divider and hence a high impedance coupling device such as an enhancement type metal oxide semiconductor field effect transistor MOSFET 42 is utilized as a coupling between the voltage divider output and the remaining portion of the detection circuitry. The drain-to-source circuit of the FET 42 is connected in series with a resistor 44 across the output of the converter 20, and a filtering capacitor 46 is connected in parallel with the resistor 44 to absorb transients. The gate of the FET is connected to the junction of the electrode 16 and the resistor 40 and thus responds to the output of the voltage divider. When the alarm device is operating, the voltage at the source of the FET follows the voltage fluctuations of the gate of the FET and, thus, serves as a signal representing the smoke conditions in the chamber.

The FET 42 is connected as a source follower to the gate of a programmable unijunction transistor PUT 50. The anode of the PUT 50 is set at a predetermined voltage level by means of the potentiometer 52 which in effect is another voltage divider energized by the converter 20. When the voltage on the gate of the PUT 50 drops approximately 0.6 volt below the anode voltage, the PUT is placed in the conductive state. The PUT, therefore, serves as a threshold device comparing the output voltages of two voltage dividers and is placed in the conductive state at the threshold level.

To produce an activating signal for the alarm horn 12, the cathode of the PUT 50 is connected through a resistor 54 to the negative or ground side of converter 20 and also to the gate of a solid state transistor amplifier or Darlington amplifier 58 so that when the PUT is placed in conduction an activating signal turns the Darlington amplifier on and energizes the annunciator or horn 12. The diode 60 is used to suppress electrical noise in the rest of the detection circuitry due to the make-and-break operation of clapper-type alarm horns or bells which are used as the annunciator.

The Darlington amplifier 58 and the annunciator 12, therefore, form an annunciation means which responds to an activating signal from the threshold circuit including the PUT 50, the potentiometer 52 and the resistors 54 and 56, when the smoke in the ionization chamber reaches the threshold level of an unsafe smoke condition. An alarm signal is then sounded and warns individuals in the immediate area of the unsafe smoke condition. After an alarm signal is given in the presence of an unsafe smoke condition, and if the smoke subsequently clears, the PUT 50 and the Darlington amplifier 58 revert to the non-conductive states and the annunciator 12 is turned off.

Since the smoke detection alarm device is intended for use in emergency situations, it is desirable that the annunciator 12 be turned on only when an unsafe smoke condition exists and that it stay on as long as the condition persists. If the smoke condition disappears, the alarm should turn off. It will be understood from the discussion above that the PUT 50 discriminates between the safe and unsafe smoke conditions and it is, accordingly, desirable that the PUT make a positive and unambiguous transition between the conductive and nonconductive states when the smoke condition increases or decreases at the threshold level. Unfortunately, the operation of the PUT's can be ambivalent at the threshold level due to negative resistance characteristics. To circumvent the ambivalence of the PUT and provide an unambiguous warning signal at a specified smoke condition, the threshold circuitry is specially designed in accordance with the present invention.

Figure 2:
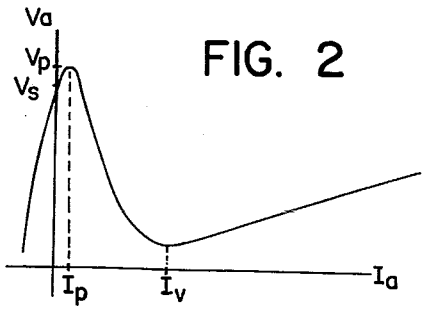
FIG. 2 is a curve illustrating the anode current characteristics of a programmable unijunction transistor in relationship to the anode-to-cathode voltage.

FIG. 2 is a graph illustrating the conduction characteristics of a PUT in the transition region and, more particularly, shows the variation of current $I_a$ from anode to cathode in relationship to the corresponding voltage $V_a$ for a fixed gate impedance. Forward conduction begins with a small peak current $I_p$ when the peak voltage $V_p$ is slightly above the gate voltage. As conduction increases, the valley current $I_v$ is reached and exceeded if proper conditions exist. It will be noted that between the peak current $I_p$ and the valley current $I_v$ the PUT exhibits a negative resistance characteristic which is due to inherent regeneration within the device. Assuming, therefore, that the PUT becomes conductive at a voltage $V_p$, the anode-cathode circuit including the potentiometer 52 and the dropping resistor 54 could establish an anode current placing the PUT in the negative resistance region between the peak current $I_p$ and the valley current $I_v$. If the PUT is permitted to operate in the negative resistance region between $I_p$ and $I_v$, the PUT does not switch unambiguously into the conductive state but, instead the anode becomes loaded and a tracking condition is observed in which the anode voltage tends to follow the gate voltage and minimal currents flow through the anode-cathode circuit. Near the threshold level such minimal currents may be too small to drive the Darlington amplifier 58 into conduction and fluctuations of the gate voltage below the threshold could cycle the alarm horn on and off. Thus a well-defined transition of the transistor from the nonconductive to the conductive state and a corresponding actuation of the amplifier 58 and the alarm horn 12 is prevented and an ambiguous condition prevails.

To avoid such ambiguity at the threshold level, the anode-gate circuit including the voltage divider formed by the potentiometer 52 and the two resistors 54 and 56 connected with the cathode of the PUT 50 are selected in conjunction with the PUT to provide anode currents which are greater than the valley current $I_v$ in FIG. 2 identifying the upper limit of the negative resistance region. Above the negative resistance region, the anode currents are large enough to clearly and unambiguously actuate the amplifier 58 and the tracking condition is avoided.

Figure 3:
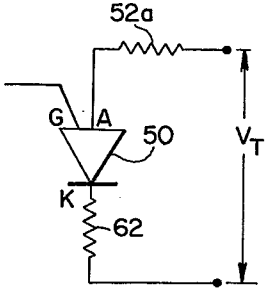
FIG. 3 is the Thevenin equivalent circuit of the anode-cathode circuit for the programmable unijunction transistor in FIG. 1.

FIG. 3 illustrates the Thevenin equivalent of the anode-cathode circuit of the PUT 50. The voltage $V_T$ represents the voltage established by the potentiometer 52 in FIG. 1 when the PUT 50 is in the nonconductive state. The resistance 52*a* is the Thevenin equivalent resistance of the potentiometer 52 while the resistance 62 is the equivalent of resistors 54 and 56 in FIG. 1. The resistors 52*a* and 62 thus determine the anode current which flows through the PUT 50 in the conductive state and the values of these resistors are selected to insure that the anode current is greater than the characteristic valley current. The resistor 56 is selected to insure sufficient base current through the Darlington amplifier to energize the annunciator 12. Providing a Darlington amplifier with adequate gain is not difficult and anticipates any limitations on the resistor 56.

To permit the alarm device to be interconnected with other remote sensors and provide the alarm signal, terminal posts 70 and 72 are connected respectively with the anode and cathode of the PUT 50. The remote sensors may detect heat, flame or other unsafe conditions and should provide a contact closure when the unsafe condition is reached. Then the terminal posts 70 and 72 are shorted by the remote sensor and the amplifier 58 and horn 12 are energized in the same fashion as if the PUT 50 was placed in a conductive state.

To permit parallel connection of several of the alarm devices, terminals 72 and 74 are provided connected respectively with the cathode of the PUT 50 and the negative terminal of the dc power supply energizing the alarm device. Thus, if one of a series of interconnected alarm devices detects smoke and places the PUT 50 in the conductive state, an activating signal is applied to each of the Darlington amplifiers 58, and each of the horns 12 is energized by its own power supply.

Additional terminal posts 76 and 78 are connected respectively to opposite sides to the horn 12 in order to permit remote annunciators to be energized along with the local horn. For example, a warning light on a remote monitoring panel connected with a plurality of the alarm devices may be energized through the terminal posts 76 and 78 whenever an unsafe smoke condition is detected by the ionization chamber 10.

In summary, the smoke detection alarm device disclosed may be energized by conventional utility power and utilizes an ionization chamber as the principal sensing element. The threshold circuitry connected with the ionization chamber utilizes a PUT to produce an activating signal for energizing the annunciator. To insure positive transition between the conductive and nonconductive states, the PUT and the anode-cathode circuitry connected with the PUT are selected to provide an anode current greater than the characteristic valley current of the PUT when the threshold level is reached and the PUT is placed in the conductive state. Various terminal posts are connected at points within the circuitry to accommodate remote sensors or annunciators and to interconnect several such alarm devices.

While the present invention has been described in a preferred embodiment, it should be understood that numerous modifications and substitutions can be made without departing from the spirit of the invention. For example, it will be understood that the ac-to-dc converter provides a regulated dc voltage and that equivalent battery or batteries may be substituted in its place. The particular annunciating device employed is illustrated as a horn; however, lights, bells and other signalling devices may be used instead. Accordingly, the present invention has been described in a preferred embodiment by way of illustration rather than limitation.

I claim:

1. A smoke detection alarm device having a stable transition into and out of an alarm condition comprising:

an ionization chamber having a radiation source and two electrodes separated by an open space through which ambient air, ions and smoke may pass, the chamber having an electrical resistance variable in relationship to the smoke within the open space;

a resistive member connected in series with one electrode of the ionization chamber to form with the ionization chamber a first voltage divider having an output at the junction of the resistive member and the one electrode;

a dc power supply connected across the voltage divider formed by the resistive member and the ionization chamber for energizing the chamber whereby smoke entering the chamber varies the chamber resistance and causes a corresponding variation in the output of the voltage divider;

annunciating means responsive to a smoke condition signal for providing an alarm signal; and threshold circuit means connected between the output of the first voltage divider and the annunciating means for unambiguously detecting transition into and out of an unsafe smoke condition in the chamber and providing to the annunciating means signals corresponding to the smoke condition existing in the chamber, the threshold circuit means including a programmable unijunction transistor and a second voltage divider connected across the dc power supply, the gate of the programmable unijunction transistor being connected with the output of one of the voltage dividers and the anode being connected with the output of the other of the voltage dividers to permit the transistor to respond to variations in the resistance of the chamber and determine the threshold condition at which the transistor switches between the non-conductive and conductive states, the transistor and the anode-cathode circuit of the transistor providing an anode current greater than the characteristic valley current of the transistor when the transistor switches into the conductive state at the threshold condition.

2. A smoke detection alarm device as defined in claim 1 wherein:

the annunciating means includes a solid state amplifier connected with the cathode of the programmable unijunction transistor to receive the smoke condition signal when the transistor is placed in the conductive state.

3. A smoke detection alarm device as defined in claim 2 wherein:

the anode-cathode circuit in the threshold circuit means also includes a resistor connecting the cathode of the programmable unijunction transistor with the negative terminal of the dc power supply; and the annunciating means includes the solid state amplifier connected to the cathode of the programmable unijunction transistor and an electrical alarm annunciator also connected across the dc power supply.

4. A smoke detection alarm device as defined in claim 3 further including two terminal posts connected respectively with the anode and cathode of the programmable unijunction transistor for activating the annunciating means from remote sensors.

5. A smoke detection alarm device as defined in claim 3 further including two terminal posts connected respectively to opposite ends of the resistor connected to the cathode of the programmable unijunction transistor for interconnecting and activating similar remote alarm devices.

6. A smoke detection alarm device as defined in claim 3 further including terminal posts connected with the alarm annunciator for parallel connection with remote annunciators.

7. A smoke detection alarm device as defined in claim 2 wherein the solid state amplifier in the annunciating means is a transistor amplifier having a transistor with a base connected with the cathode of the programmable unijunction transistor.

8. A smoke detection alarm device as defined in claim 1 further including a high impedance circuit interposed between the first voltage divider and the threshold circuit and including a field effect transistor with a gate connected to the output of the first voltage divider and a source follower output connected to the gate of the programmable unijunction transistor.

9. A smoke detection alarm device defined in claim 1 wherein the anode of the programmable unijunction transistor is connected to the output of the second voltage divider and the gate of the transistor is connected with the output of the first voltage divider.

10. A smoke detection alarm device as defined in claim 1 wherein the annunicating means further includes a non-latching amplifier coupled to the cathode of the programmable unijunction transistor to receive the signals corresponding to the smoke condition existing in the chamber.

* * * * *